US010905190B2

(12) United States Patent
Velazquez

(10) Patent No.: US 10,905,190 B2
(45) Date of Patent: Feb. 2, 2021

(54) ADJUSTABLE SANDAL CONSTRUCTION

(71) Applicant: Wolverine Outdoors, Inc., Rockford, MI (US)

(72) Inventor: Omar Velazquez, Grand Rapids, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

(21) Appl. No.: 16/391,841

(22) Filed: Apr. 23, 2019

(65) Prior Publication Data

US 2020/0337412 A1 Oct. 29, 2020

(51) Int. Cl.
*A43B 3/12* (2006.01)

(52) U.S. Cl.
CPC ..... *A43B 3/126* (2013.01); *A43B 3/122* (2013.01)

(58) Field of Classification Search
CPC ..... A43B 3/12; A43B 3/122; A43B 3/126
USPC ..... 36/11.5; D2/916
See application file for complete search history.

(56) References Cited

U.S. PATENT DOCUMENTS

D94,639 S * 2/1935 Stritter ..... D2/935
4,793,075 A * 12/1988 Thatcher ..... A43C 11/1493 36/11.5
4,869,000 A 9/1989 York, Jr.
5,228,216 A 7/1993 Sargeant
5,438,767 A * 8/1995 Stein ..... A43B 3/12 36/11.5
RE35,452 E * 2/1997 Sargeant ..... A43B 3/126 36/11.5
D417,942 S * 12/1999 Aguerre ..... D2/916
6,021,585 A 2/2000 Cole
6,237,250 B1 * 5/2001 Aguerre ..... A43B 3/122 36/11.5
D460,245 S * 7/2002 Butler ..... D2/916
6,606,803 B1 * 8/2003 Ritter ..... A43B 3/126 36/11.5
6,637,130 B2 10/2003 Urie et al.
(Continued)

OTHER PUBLICATIONS

Pictures of Chaco Z/1 Classic Sandal downloaded from https://www.chacos.com/US/en/z-1-classic/24081M.html?dwvar_24081M_color=J106549#cgid=men-featured-best-sellers&start=1, at least as early as Apr. 22, 2019.
(Continued)

*Primary Examiner* — Marie D Bays
(74) *Attorney, Agent, or Firm* — Warner Norcross + Judd LLP

(57) ABSTRACT

A sandal construction including a sole assembly, an adjustable strap system, and an ankle post extending up from and affixed to the sole in the ankle region. The ankle post includes three slots arranged in a generally triangular configuration. The strap system includes a strap, a portion of which is threaded through the slots in the ankle post and extending behind the heel of a wearer's foot and from the ankle region into the forefoot region. The strap is folded as it passes between two slots to control the orientation of the strap portions and to allow deliberate adjustment of the strap, but resist unintentional movement of the strap. The strap is selectively moveable through the slots to loosen and tighten the strap through both the ankle and forefoot regions to adjust the fit of the sandal to the wearer's foot.

11 Claims, 10 Drawing Sheets

(56) References Cited

U.S. PATENT DOCUMENTS

| | | | | |
|---|---|---|---|---|
| 6,694,641 | B1 * | 2/2004 | Gill | A43B 3/122 36/11.5 |
| 7,103,993 | B2 * | 9/2006 | Sakai | A43B 3/122 36/11.5 |
| 7,222,440 | B2 * | 5/2007 | Dombowsky | A43B 3/16 36/11.5 |
| 7,788,827 | B2 * | 9/2010 | Fogg | A43B 3/128 36/103 |
| 8,839,529 | B1 * | 9/2014 | Levy | A43B 3/126 24/442 |
| 2005/0268485 | A1 * | 12/2005 | Sakai | A43C 11/14 36/11.5 |
| 2014/0144048 | A1 * | 5/2014 | McDonald | A43B 3/126 36/103 |
| 2016/0007673 | A1 * | 1/2016 | McDonald | A43B 3/126 36/11.5 |
| 2017/0143071 | A1 | 5/2017 | Huang et al. | |

OTHER PUBLICATIONS

Pictures of Chaco Z/2 Classic Sandal downloaded from https://www.chacos.com/US/en/z-2-classic/24083M.html?dwvar_24083M_color=J106559#cgid=men-featured-best-sellers&start=1, at least as early as Apr. 22, 2019.

* cited by examiner

ADJUSTABLE SANDAL CONSTRUCTION

BACKGROUND OF THE INVENTION

The present invention relates to footwear and more particularly to footwear in which the upper incorporates one or more straps, such as sandals.

Sandals are available in a variety of different types and styles, many of which are customized to serve different functions. One type of sandal that is particularly popular in today's commercial market is a sport sandal. Despite the name, sports sandals are commonly used for a wide range of activities and are not limited to use in sporting activities. Conventional sport sandals may include a contoured sole and a strapping system for retaining the sole against the bottom of a foot. Although strapping systems vary from sandal to sandal, many typical sports sandals include a front strap for retaining the forefoot, and ankle and heel straps that cooperatively retain the rear portion of the foot. The design and configuration of the straps may vary significantly from sandal to sandal. However, in one example of a conventional sport sandal, the front strap extends over the forefoot of the foot and includes opposite ends that are generally affixed to the sole. The front strap is typically length-adjustable to permit the sandal to be adjusted to snuggly fit different size feet. With this example, the ankle strap will typically extend over the top surface of the foot just in front of the ankle and includes opposite ends affixed to inner and outer ankle posts, or directly to the sole. The ankle strap is often adjustable to control the fit. The heel strap of this example wraps around the rear heel portion of the foot and, like the ankle strap, is affixed to the ankle posts or directly to the sole. As with the other straps, the heel strap may be adjustable in length to permit the sandal to be adjusted to not only allow the strap to snuggly fit different size feet, but also to help position the foot properly on the sole. The ankle posts typically provide a certain degree of rigidity, and the front and heel straps can be attached to the ankle posts or directly to the sole. The straps may be attached to the ankle posts by stitching, riveting, or stapling, and/or can be embedded or adhered within the sole. Many conventional attachments render one or more of the straps non-replaceable, or, at best, not readily replaceable.

Some manufacturers have combined the forefoot strap and the ankle strap into a single "forward" strap that is configured for tightening and loosening the forward portion of the sandal in a single action. By adjusting this single strap, the sandal may be secured on the foot and the fit of the sandal in both the ankle and forefoot regions may be controlled. The Chaco Z Classic Sandal, available from Wolverine World Wide of Rockford, Mich., is a popular and well-known example of a sandal with this type of single forward strap. This sandal has a particularly effective implementation of a single forward strap that wraps through the sole and over the user's foot in the ankle and forefoot regions to firmly and comfortably hold the sandal to the wearer's foot for both casual and sport activities.

Despite the comfort, effectiveness and ease of use available in some conventional sandal strap systems, consumers may benefit from further improvements in the field of strap systems, particularly in the context of sandals that may be used in sporting activities.

SUMMARY OF THE INVENTION

Footwear is provided including a sole assembly having an adjustable strap system that includes a portion that tightens through an ankle region and a forefoot region of the footwear to secure the footwear on a wearer's foot. The present invention provides a sandal having a continuous strap permitting simultaneous strap adjustment behind the wearer's heel and over at least a portion of the wearer's ankle or forefoot.

In one embodiment, a sandal includes a sole and at least one ankle post extending up from the sole in the ankle region. The ankle post may be disposed on the lateral or medial side of the sole. A strap guide feature is disposed on the ankle post and can include an arrangement of keepers. The sandal includes a strap, a continuous portion of which is threaded through the keepers and extends across the sole at or forward of the ankle region and around a heel of a wearer's foot. The strap is selectively moveable through the keepers to loosen and tighten the strap around the heel and over at least one of the ankle and forefoot regions to secure the sandal on the wearer's foot.

In one embodiment, the keepers include an arrangement of slots defined in a first ankle post. The strap is folded as it passes through one of the slots to not only control the orientation of the strap portions entering and exiting the slot, but also to assist in providing a controlled level of resistance to movement of the strap through the keepers.

In another embodiment, a sandal includes a sandal strap construction in which a portion of a strap is threaded through an arrangement of slots in the ankle post. The strap is selectively movable in the longitudinal direction through the slots to provide an adjustable strap. The design and configuration of the slots, the strap, and the threading pattern may be selected to facilitate intentional movement of the strap through the slots, but to resist unintentional movement.

In one embodiment, the arrangement of slots includes three slots arranged in a generally triangular configuration. In this embodiment, the strap is threaded through the first slot, threaded and folded through the second slot, and then threaded through the third slot. In one embodiment, the first slot extends at an angle of about +45 degrees with respect to the second slot, the second slot extends at an angle of about −5 degrees to +5 degrees from horizontal, and the third slot extends at an angle of about −45 degrees with respect to the second slot. The arrangement of the slots and the threading pattern facilitate intentional adjustment of the strap through the ankle post, yet resist unintentional slipping of the strap through the ankle post.

In one embodiment, the arrangement of slots provides proper orientation of the strap segments with respect to the wearer's foot. The angles of the first, second and third slots can be selected to orient and maintain a comfortable position of the strap around the back of the heel and over the ankle, arch, midfoot and/or forefoot regions.

In another embodiment, the ankle post(s) includes a press molded, contoured impression in selected areas. The impression can be included in the areas where the strap lies adjacent an inner surface of the post so that the strap can be "nested" in the impression, providing a more flush, and more comfortable, inner surface that contacts the wearer's foot.

In one embodiment, the ankle post include a reinforcing grommet. The grommet provides additional structural stability to the ankle post and can improve wear resistance due to pulling the strap through the slots. The grommet may be a single piece shaped as desired, or may be three discreet pieces, extending around the perimeter of each of the slots.

In another embodiment, the strap has first and second sides (or major surfaces) which can include different colors and/or patterns. Following the described threading pattern, the strap is threaded through the first slot with either the first or second side facing outward. The strap is folded over, and then threaded through the third slot so that the opposite side is facing outward. In this manner, the forefoot portion of the sandal can exhibit one color/pattern and the heel portion of the sandal can exhibit a second color/pattern. This feature provides additional design options for the color/pattern scheme and overall appearance of the shoe.

In one embodiment, the strap is threaded through an arrangement of slots in both the lateral and medial ankle posts, thereby providing adjustability through both ankle posts.

In one embodiment, a first end of the strap is affixed to the sole. The strap crosses the sole in the forefoot region and extends from the forefoot region to the ankle region, transitioning from the lateral to the medial side. The strap loops through a slot in the medial ankle post and crosses to the lateral ankle post, forward of an ankle of a wearer. The strap is threaded through first, second, and third slots of the lateral ankle post and then crosses to the medial ankle post behind the heel of a wearer. The strap terminates at a second end, which is affixed to the medial ankle post.

In one embodiment, the sandal includes an adjustment mechanism, for example a buckle, for adjusting the length of the strap. The buckle is configured to loosen and tighten the strap around the wearer's foot in both the ankle and forefoot regions.

In one embodiment, a width of the first, second, and third slots and a thickness of the strap can be selectively sized relative to one another. The relative sizing can be selected to allow intentional or deliberate movement (adjustment) of the strap while at the same time providing a desired amount of resistance to unintentional movement, such as slipping, of the strap.

The present invention provides a simple and effective strap arrangement that provides adjustment forward and rearward of the ankle through movement of a single continuous strap or strap portion. The present invention is elegant in its ability to provide a variety of features without the need for multiple or complex adjustment components. For example, the present invention simultaneously provides control over the position and orientation of the strap forward of the ankle post and rearward of the ankle post through configuration of the triangular arrangement of keepers. The continuous strap and keeper arrangement not only simplifies manufacture, but it is also highly reliable over extended use. The present invention also allows the adjustment tension to be designed into the construction of the sandal. Further, folding the strap as it passes through one of the slots results in the strap being flipped, thereby providing opportunities for unique and distinctive visual aesthetics. For example, the strap may have different patterns on opposite sides and the fold may give the heel portion of the strap a different appearance that the strap portions forward of the fold.

The present invention also provides a simple and readily replaceable strap arrangement in the event that the sandal strap should wear out or become damaged. Often times, the straps of the sandal wear out before the durable rubber sole. Replacing the strap instead of throwing the entire sandal out extends the life of the sandal, which not only enables the customer to get more wear out of their sandals, but it is good for the environment. The present invention can be implemented in a way that makes replacing the strap relatively easy to do. For example, to attach the strap to the sole, opposite ends of the strap may be looped over/through a ring or slot affixed to the sole and/or the ankle post and then stitched onto itself. To replace the strap, the stitching is removed at both ends, a new strap is looped over/through the rings or slots at both ends, and then the strap ends can be stitched onto themselves in the same location.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Figure 1:
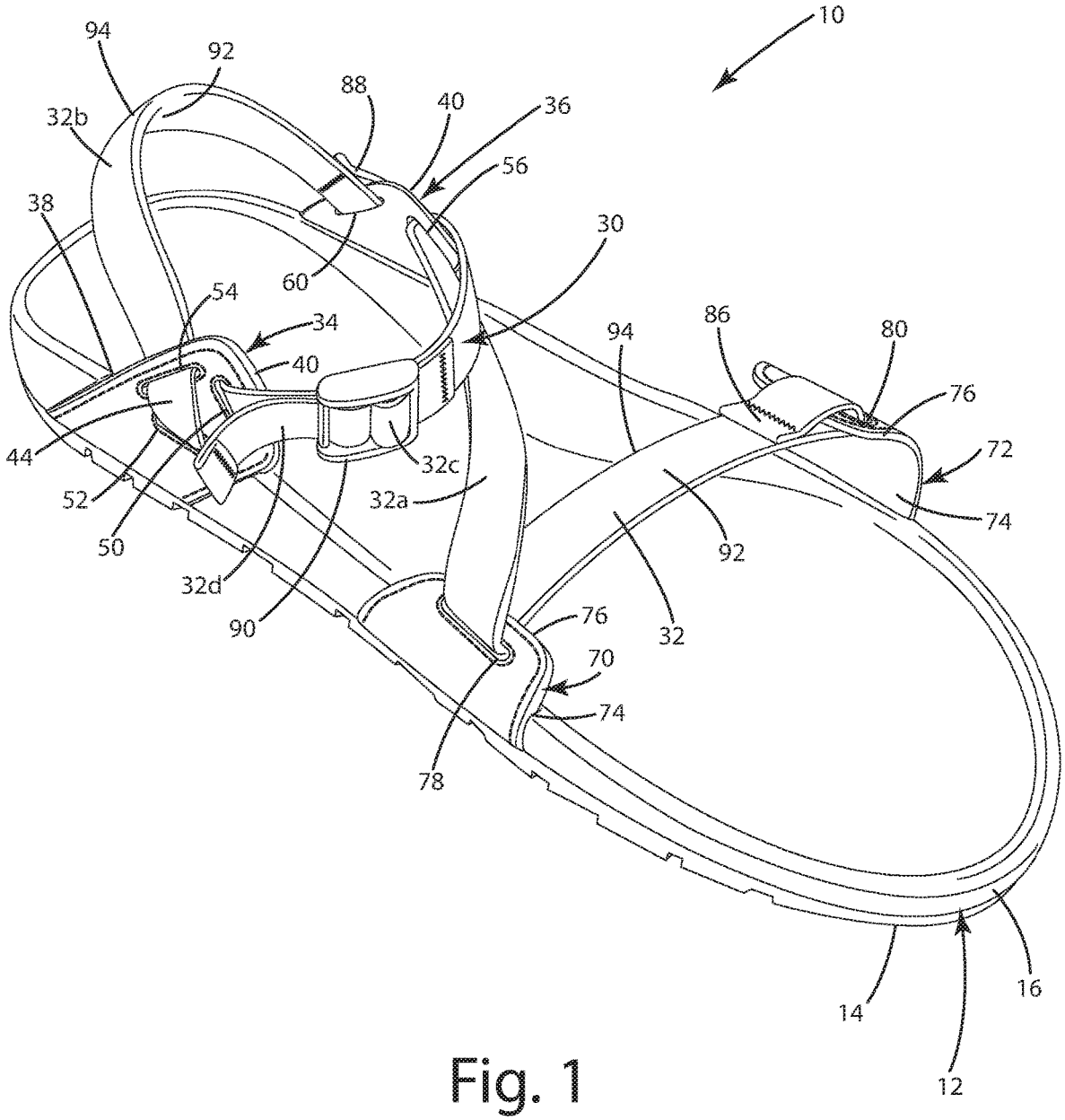
FIG. 1 is a perspective view of a sandal incorporating an adjustable strap system in accordance with an embodiment of the present invention.

A sandal constructed in accordance with an embodiment of the present invention is shown in FIG. 1 and generally designated 10. In general, the sandal 10 includes a sole assembly 12 and a strap system 30. The sole assembly 12 of the illustrated embodiment includes an outsole 14 and a midsole 16. The strap system 30 of this embodiment includes a single continuous and adjustable strap 32 that crosses back and forth over the forefoot, midfoot, and ankle, and around the rear of the heel to retain a wearer's foot.

The sandal 10 of FIG. 1 is merely exemplary and the various aspects of the present invention may be incorporated into a wide range of alternative sandal constructions, including sandals with alternative strap configurations, alternative sole constructions and/or alternative upper constructions. The illustrated sandal 10 is intended to be worn on the right foot and will be described in detail. Of course, a sandal intended to be worn on the left foot may be a mirror image of the illustrated sandal 10. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations.

Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "ankle region" (or ankle or heel) refers generally to that portion of the footwear rearward of the arch region corresponding to the ankle and/or heel of the wearer's foot. The forefoot region 22, arch region or mid-foot region 24, and ankle or heel region 26 generally are identified in FIG. 2. The sole assembly 12 and strap system 30 each have a corresponding forefoot portion, arch region or mid-foot portion, and ankle portion within these regions 22-26. However, it is to be understood that delineation of these regions may vary depending upon the configuration of the sole assembly and/or footwear.

Figure 3:
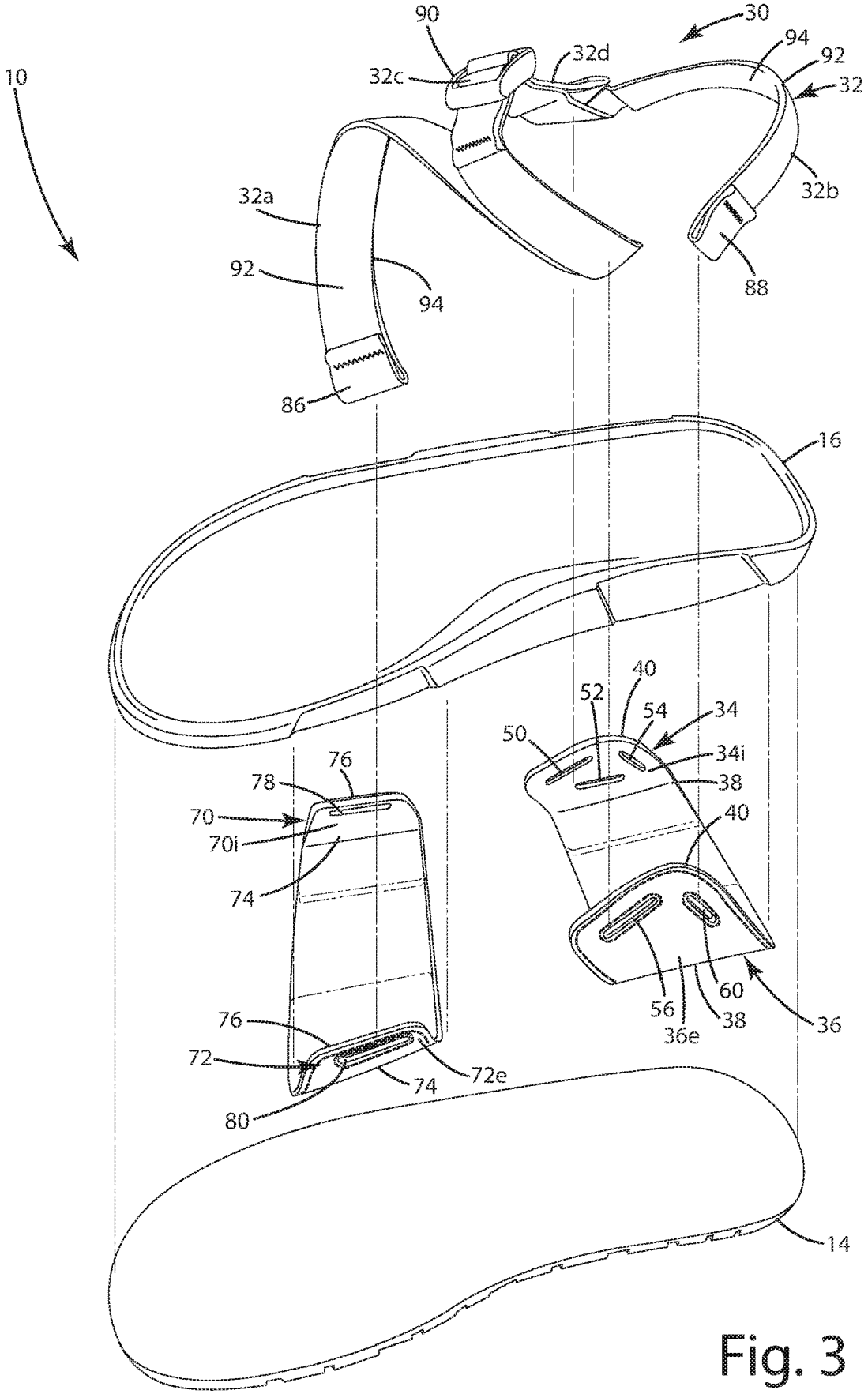
FIG. 3 is an exploded view of the sandal.

As noted above, the sandal 10 of FIG. 1 generally includes a sole assembly 12 and a strap system 30 that are interconnected. FIG. 3 is an exploded view of the sandal 10 showing various parts of the sandal 10 in separation. The sole assembly 12 defines a foot-shaped perimeter and can include one or more different components, such as a midsole 16 configured to mirror the shape of the undersurface of a typical wearer's foot. In this embodiment, the outsole 14 forms the ground-engaging layer of the sandal 10. The outsole 14 of FIG. 1 is generally conventional and is made of conventional outsole materials (such as rubber or a rubber compound) that are selected to provide the desired balance between comfort, wear, and traction. Although the outsole 14 may be manufactured from a conventional rubber compound, a variety of other materials may be used to provide the desired comfort, wear, and traction. The bottom surface of the outsole 14 may include treads, lugs, spikes, cleats, and/or other features designed to enhance traction. The design and configuration of the outsole 14 may vary from application to application as desired. Generally, regardless of which components are present, the sole assembly 12 can form the bottommost portion of the sandal 10.

Referring to FIGS. 1-5, the sandal 10 includes an upper in the form of a strap system 30. In the illustrated embodiment, the strap system 30 includes a strap 32 attached to a pair of generally upright lateral and medial ankle posts 34 and 36 extending upwardly along respective sides of the sole assembly 12 in the ankle region 26. The ankle posts 34, 36 include bottom end portions 38 and upper end portions 40. The bottom end portions 38 are anchored to the sole assembly 12 and may be sandwiched between the outsole 14 and the midsole 16, or cemented to the midsole 16 or the outsole 14, for example. In a similar fashion, the strap system 30 can include one or more forefoot posts. In the illustrated embodiment, the sandal 10 includes lateral and medial forefoot posts 70 and 72 that extend upwardly along opposite sides of the sole assembly 12 in the forefoot region 22. The forefoot posts 70, 72 include bottom end portions 74 and upper end portions 76. The bottom end portions 74 are anchored to the strap assembly 12 and may be sandwiched between the outsole 14 and the midsole 16, for example, or may be cemented to the midsole 16 or the outsole 14. Further, it should be understood that the forefoot and ankle posts need not be connected across the width of the sole as in a one-piece construction. For example, as shown in dashed line in FIG. 3, each post may be a discrete component and may not extend all the way across the sole. Further still, if the pairs of posts are provided as one-piece, some layers of the posts, described in greater detail below, may not extend across the sole.

Figure 4A:
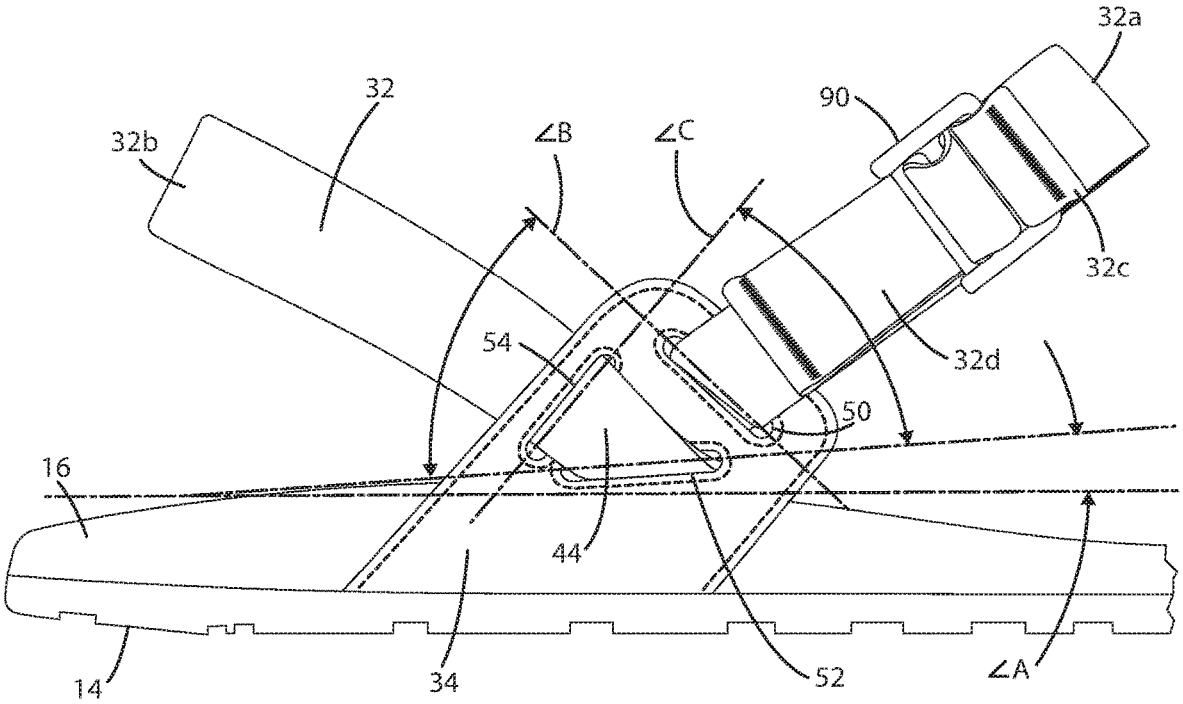
FIG. 4A is a partial side view of the ankle portion of the sandal.

As perhaps best shown in FIG. 4A, the lateral ankle post 34 of the illustrated embodiment defines a guide feature disposed toward the upper end portion 40 of the lateral ankle post 34. The guide feature includes an arrangement of multiple keepers. As shown, the keepers are in the form of slots through the lateral ankle post 34, including a first slot 50, a second slot 52, and a third slot 54. In the embodiment of FIG. 1, the medial ankle post 36 also defines a guide feature in the form of fourth and sixth slots 56 and 60 therethrough. In alternative embodiments, the medial ankle post 36 may also include a fifth slot 58 therethrough (see FIG. 7). Referring back to FIG. 1, in the illustrated embodiment, the forefoot posts 70, 72 can also define guide features in the form of respective lateral and medial slots 78 and 80 therethrough which are disposed toward the upper end portion 76 of each post. It should be understood that the terms "keeper" and "slot" are used broadly and refer to any structure for receiving and/or retaining a strap to the ankle and forefoot posts in a pass-through arrangement. These terms can also be used to include, for example, a loop, a tunnel, a channel, a hoop, an eyelet, an elliptical ring, or the like, or multiples thereof.

Figure 5:
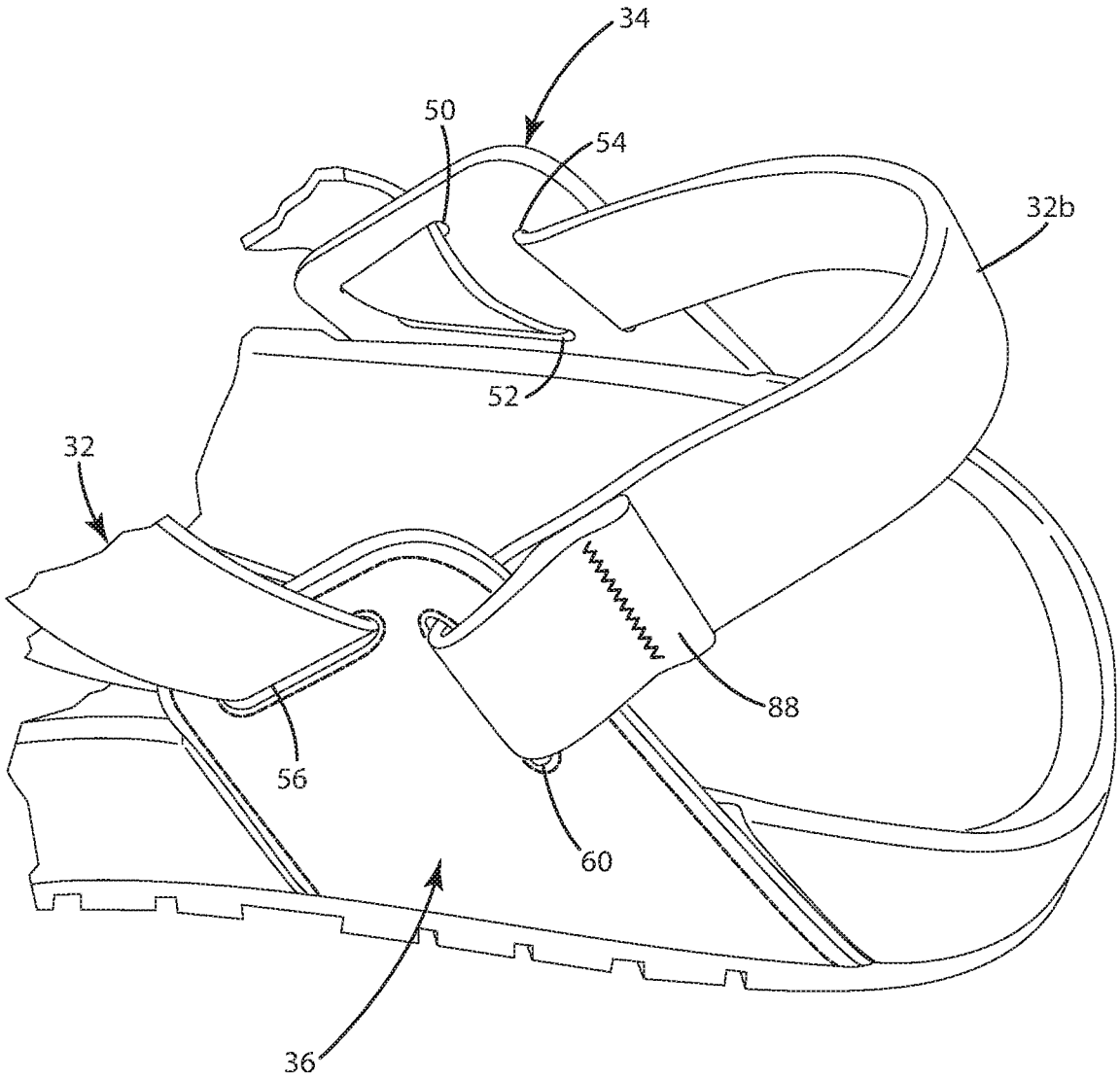
FIG. 5 is a partial perspective view of the ankle portion of the sandal.

In the illustrated embodiment, the arrangement of slots includes first, second, and third slots 50-54 arranged in a substantially triangular configuration, as shown in FIGS. 4A and 5. The second slot 52 is oriented substantially horizontal. For example, the second slot 52 may be oriented at an angle within the range of ±5 degrees from horizontal in some embodiments or in the range of ±10 degrees from the horizontal in other embodiments. FIG. 4A shows the slot at an angle of approximately two degrees from horizontal. The orientation of the second and third slots 50 and 54 may be determined relative to the second slot 52. In this embodiment, the first slot 50 extends at an angle B approximately +45 degrees relative to the second slot 52, and the third slot 54 extends at an angle C approximately −45 degrees relative to the second slot 52. As described in greater detail below, in use, the described geometric arrangement of the slots positions and maintains the strap 32 in a preselected orientation with respect to the wearer's foot to comfortably extend behind the wearer's heel and over the forefoot/midfoot to retain the wearer's foot to the sandal 10. The slots can be arranged relative to one another, with the angle between the first and third slots 50, 54 being approximately 90 degrees. Of course, it should be readily understood that the angle of each slot may be varied. For example, the angle of the first and third slots 50, 54 may be in the range of +40 to +50 degrees and −40 to −50 degrees, respectively, or in the range of +30 to +60 degrees and −30 to −60 degrees, respectively. In typical applications, the first and third slots will extend at substantially the same angle (albeit in opposite directions) to the second slot 52, which will reduce the likelihood of buckling and allow the strap to lay more flatly as it passes through the guide features in the lateral ankle post 34. Additionally, in the embodiment illustrated in FIG. 1, fourth and fifth slots 56, 58 of the medial ankle post 36 can be arranged in substantially the same orientation as that of slots 50 and 54 of the lateral ankle post 34. In an alternative embodiment illustrated in FIG. 7, the medial ankle post 36 includes a fifth slot 58 arranged in substantially the same orientation as slot second 52 of the lateral ankle post 34. It should be understood that the slots of the two ankle posts need not be arranged in the same orientation and may vary from lateral to medial side as desired.

Figure 4B:
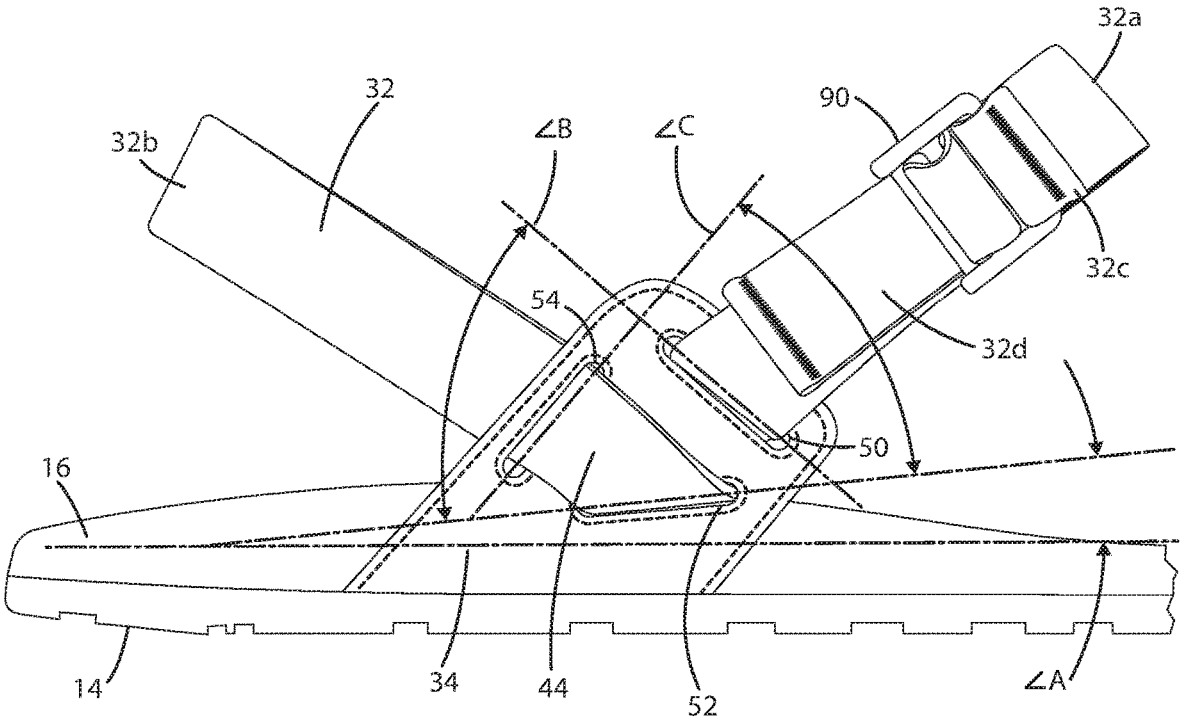
FIG. 4B is a partial side view of the ankle portion of the sandal, illustrating a tilted orientation of ankle post slots.

An alternative slot arrangement is shown in FIG. 4B. In the embodiment of FIG. 4B, the second slot 52 extends at an angle (angle A) of about four degrees from horizontal. As noted above, however, the angle of the second slot can be oriented at different angles. For example, angle A may extend at an angle in the range of about −5 degrees to about +5 degrees from horizontal, with the rear of the slot 52 being closer to the ground surface. Angles B and C of the first and third slots 50, 54 remain angled relative to angle A as described above. By changing the angle of the slots, the fit of the ankle and heel straps to the wearer's foot can be altered or modified. Tilting the arrangement of slots relative to horizontal may be used to adjust the fit of the straps on the wearer's foot. For example, tilting the slots in a direction that raises the forward end of the second slot 52 may result in raising the location at which the strap engages the foot forward of the ankle and in lowering the location at which the strap engages the back of the heel. The amount of tilt may be adjusted to simultaneously tune the position of the strap behind the heel and forward of the ankle. In the embodiment of FIG. 4B, the four-degree tilt comfortably positions the strap 32 lower on the heel and higher on the ankle/midfoot.

Figure 2:
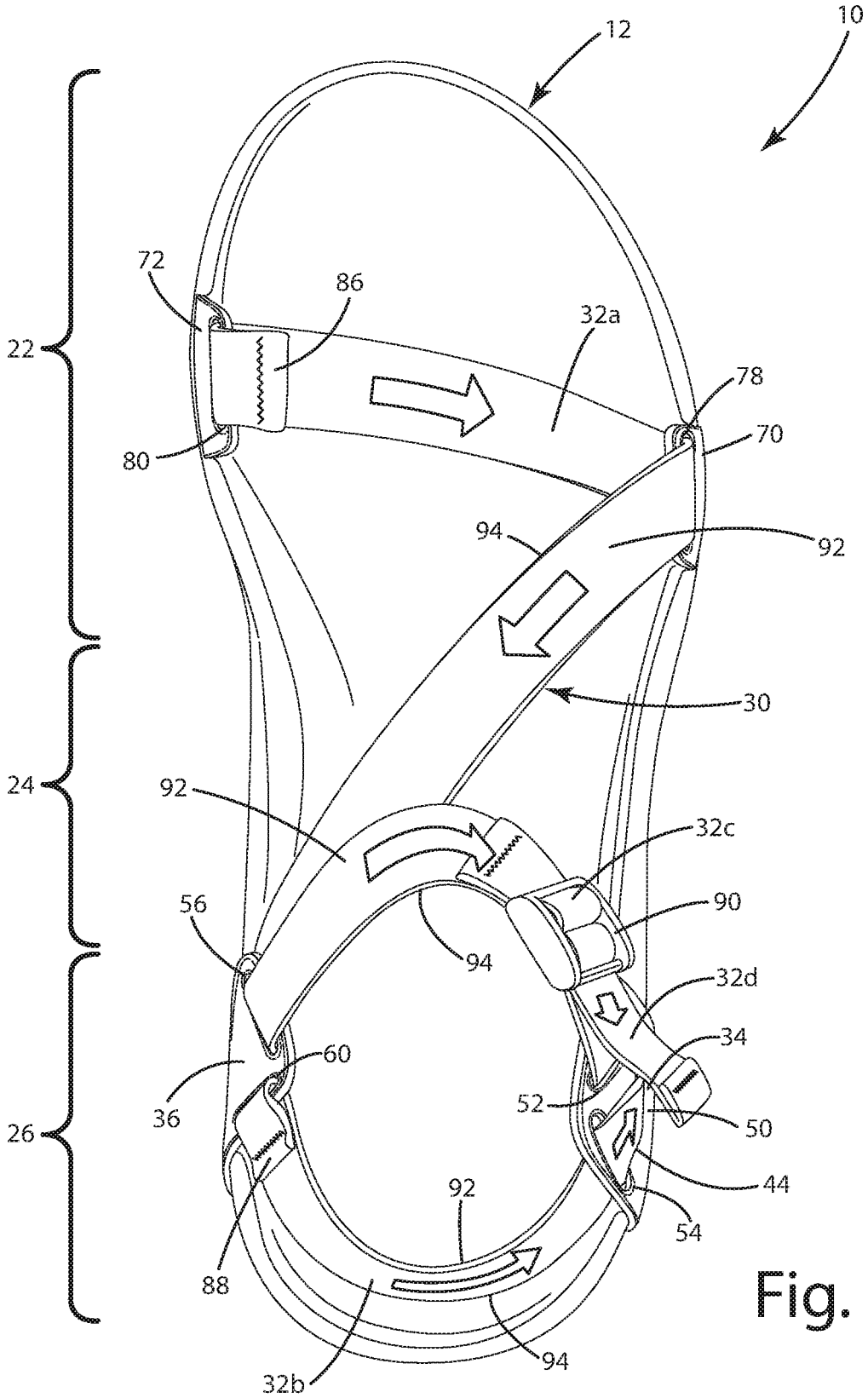
FIG. 2 is a top view of the sandal.

Referring to FIGS. 1-3, one embodiment of the strap system 30 is illustrated. In this embodiment, the strap 32 defines first and second opposed ends 86 and 88 having a length defined between the ends 86, 88. The first strap end 86 is configured to be joined with the sole assembly 12 in the forefoot region 22, and the second strap end 88 is configured to be joined with the sole assembly 12 in the ankle region 26. In one embodiment, the strap 32 can extend through the slot 80 of the medial forefoot post 72, and the first end 86 can be looped back (doubled back) over and attached to itself via stitching. In a similar fashion, the strap 32 can extend through the sixth slot 60 in the medial ankle post 36, and the second end 88 can be looped back over and attached to itself via stitching. Other various conventional methods such as adhesive, riveting, or stapling may be used to attach the strap to itself.

The strap 32 crosses back and forth over the forefoot and midfoot, and behind the heel, to retain the wearer's foot. In this embodiment, as noted above, the first end 86 of the strap 32 is affixed to the sole assembly 12 via looping through the medial slot 80 in the medial forefoot post 72. From there, the strap 32 crosses the sole assembly 12 in the forefoot region 22 and passes through the lateral slot 78 of lateral forefoot post 70. The strap 32 again crosses the sole assembly 12, from the lateral side to the medial side and extends over the top of the foot between the forefoot region 22 and the ankle region 26. The strap 32 continues through the fourth slot 56 in the medial ankle post 36. After emerging from the slot 56, the strap crosses from the medial ankle post 36 to the lateral ankle post 34, forward of an ankle of the wearer. The strap 32 is threaded through the slots of the lateral ankle post 34 in a defined threading pattern. As shown, the threading pattern includes threading the strap 32 straight through the first slot 50; the strap 32 emerges from the first slot 50 and extends out through the second slot 52. The strap 32 is then twisted or folded 44 upon itself and then continues straight though the third slot 54 to complete the threading pattern. After passing through the lateral ankle post 34, the strap 32 crosses to the medial ankle post 36, rearward of the wearer's heel. As noted above, the strap 32 terminates at its second end 88 by looping back over and attaching to itself via stitching. The illustrated strap arrangement and threading pattern are merely exemplary and the present invention may be implement in sandals having other strap arrangements and threading patterns.

Referring to FIG. 2, in this embodiment, the strap system 30 may include a length-adjustment mechanism. For example, the strap system 30 can include a buckle 90 on the strap 32 between ankle posts 34, 36 for adjusting the effective length of the strap 32. The strap 32 is split at buckle 90, thus defining a strap forefoot portion 32*a* and a strap heel portion 32*b* terminating in respective forefoot portion end 32*c* and heel portion end 32*d*. The strap forefoot portion 32*a* is affixed to the buckle 90 at the forefoot portion end 32*c*, and the strap heel portion 32*b* is fed through the buckle 90 in a conventional manner. The heel portion end 32*d* is left free for a user to pull to allow the effective length of the entire strap 32 to be adjusted. Pulling the heel portion end 32*d* draws the forefoot portion end 32*c* toward the lateral ankle post 34, thus tightening the strap forefoot portion 32*a* against the foot. Simultaneously, pulling the heel portion end 32*d* shortens the effective length of the strap heel portion 32*b*. In this arrangement, the buckle 90 is configured to tighten the strap 32 throughout both the ankle region 26 and the forefoot region 22 as illustrated with arrows in FIG. 2. Of course, loosening the strap 32 is performed substantially opposite as described above for tightening/shortening the strap 32 by pulling on the buckle 90 to release the tension on the strap 32 as is conventional. It should be noted that what is meant by "effective length" of the strap 32 is the length of the strap 32 that is retaining the sandal to the foot, and does not include the length that is free for the user to pull. In another embodiment, the orientation of the buckle 90 may be reversed—the strap heel portion 32*b* is affixed to the buckle 90 at the heel portion end 32*d*, and the strap forefoot portion 32*a* is fed through the buckle 90 in a conventional manner. In this orientation, the forefoot portion end 32*c* is left free for a user to pull to allow the effective length of the entire strap 32 to be adjusted. In this case, pulling the forefoot portion end 32*c* pulls the heel portion end 32*d* away from the lateral ankle post 34, thus tightening the strap heel portion 32*b* behind the heel and shortening the effective length of the strap forefoot portion 32*a*. It should be understood that a length-adjustment mechanism is not limited to the exemplary buckle, but may be any suitable adjustment mechanism that allows adjustment of the effective length of the strap.

The strap 32 is capable of selective movement, for example sliding, through slots 50-54 of lateral ankle post 34. This permits the strap forefoot and heel portions 32*a*, 32*b* to be adjusted and therefore allows the strap 32 to tighten or loosen in both the ankle region 26 and the forefoot region 22 to provide a custom fit to any foot. In one embodiment, the amount of force required to adjust the strap 32 through the slots 50-54 may be varied by adjusting the fit of the strap 32 through the slots 50-54. For example, a tighter fit may be used to increase the resistance to movement of the strap 32 and a looser fit be provided to make movement easier. The width (opening) of the slots 50-54 and the thickness of the strap 32 are relative, and can be selected to provide a desired amount of resistance to movement. Further, the aforementioned threading pattern, including the fold 44, provides intention adjustment of the strap 32 through the lateral ankle post 34 while resisting unintentional slipping of the strap 32 back through the lateral ankle post 34. For example, the fold 44 in the strap 32 assists in providing a controlled level of resistance to movement. Together, these features—the geometric arrangement of the slots 50-54 and the relative width and thickness of the slots 50-54 and strap 32—influence the amount of force required to adjust the strap 32 through the slots 50-54. This enables the adjustment tension to be designed into the construction of the sandal 10. Additional factors that may influence the force required to adjust the strap can include the texture and/or coefficient of friction of the strap 32 and the surface of the slots 50-54.

In another embodiment, the strap 32 defines first and second sides 92 and 94 (or major surfaces), otherwise considered an inside and an outside of the strap. Following the threading pattern through the lateral ankle post 34 as described above, the strap 32 is threaded through the first slot 50 with the first side 92 facing outward (away from the foot). The strap 32 is folded or twisted between the second and third slots 52, 54 such that the second side 94 of the strap 32 is facing outward. In this embodiment, the inherent fold that occurs when the strap 32 passes through slot 52 results in the strap 32 being flipped, exposing opposite sides of the strap 32 on opposite sides of the fold. In other words, one side of the strap 32 faces outward on one side of (before or after) the fold 44, and the other side of the strap 32 faces outward on the other side of (before or after) the fold 44. This arrangement provides opportunities for unique and distinctive visual aesthetics. For example, the strap 32 may have different patterns and/or colors on the first and second sides 92, 94 and the fold 44 may reverse the exposed side of strap, thereby providing the strap rearward of the fold a different appearance than the strap forward of the fold. It should be understood that the first and second strap sides 92, 94 can be the same or different.

The strap 32 can be formed of a nylon, polymer, leather, canvas or a variety of other materials or combinations of materials. A variety of other configurations may also be used to form the strap 32. Optionally, the strap 32 is in a web form, with a width at least 2, 3, 5, 10, or even 20 times the thickness of the strap 32. Of course, the strap 32 can be constructed from any elongated element, such as cord, rope, strands, and the like, depending on the application.

In some embodiments, the ankle posts 34, 36 may include additional slots (or other guide features). For example, the first and third slots 50, 54 can include additional aligned—but spaced—slots. In this case, the strap 32 can be threaded through the slots additional times. Additional guide features may be added to help is positioning the strap or in controlling the tension required to move the strap through the guide features.

In some embodiments, the ankle posts 34, 36 and optionally the forefoot posts 70, 72 may be of a laminated and/or layered construction. For example, the posts can include an exterior layer 34*e*, 36*e*, 70*e*, 72*e* and an inner lining 34*i*, 36*i*, 70*i*, 72*i*. The exterior layer 34*e*, 36*e*, 70*e*, 72*e* can be made of leather, synthetic leather, plastic, canvas, or a variety of other materials or combinations of materials. The inner lining 34*i*, 36*i*, 70*i*, 72*i* can be made of neoprene, Cambrelle®, softer leather, polyester, acrylic, microfiber, cotton, linen, and neoprene. The lining 34*i*, 36*i*, 70*i*, 72*i* lines the inside of the exterior layer 34*e*, 36*e*, 70*e*, 72*e* to provide a softer, comfortable material to contact the wearer's foot. The layers can be stitched, adhered, or otherwise affixed together as desired.

Figure 6:
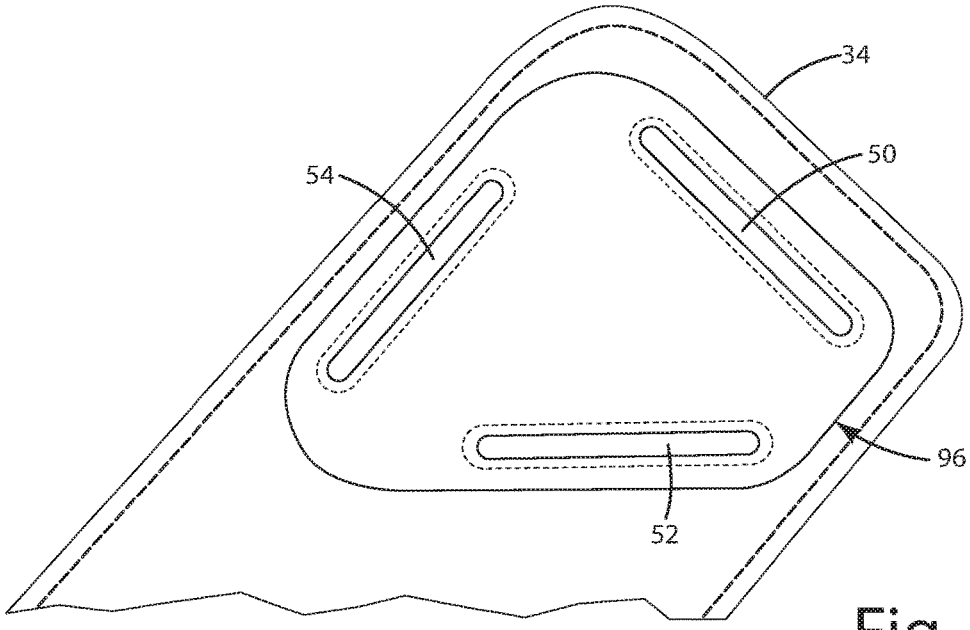
FIG. 6 is an enlarged view of the ankle post of the sandal with the strap removed and incorporating a grommet.

Referring to FIG. 6, in another embodiment, the ankle posts 34, 36 may include a reinforcing grommet 96. The grommet 96 can be formed of a more durable, wear resistant material, such as plastic, and can be affixed to the ankle posts 34, 36 via any suitable method, including, as examples, adhesives, stitching, friction fitting, forms of plastic welding and sonic welding. The grommet 96 can be shaped as desired to fit on the ankle posts 34, 36, and can extend into and/or through any of the slots 50-60. The grommet 96 provides additional structural stability to the ankle posts 34, 36 and can improve wear resistance due to pulling the strap 32 through the slots 50-60. Additionally, the grommet 96 can be included to provide unique and distinctive visual aesthetics through the color and pattern designed into the grommet 96. Optionally, the grommet 96 can be three discreet elements, each extending around the perimeter of each of the slots. Further optionally, the grommet 96 may be stitched to the exterior layer 34*e*, 36*e* or the inner lining 34*i*, 36*i* of the ankle posts 34, 36, or the grommet 96 may be positioned between the aforementioned layers of the ankle post 34, 36.

Figure 9:
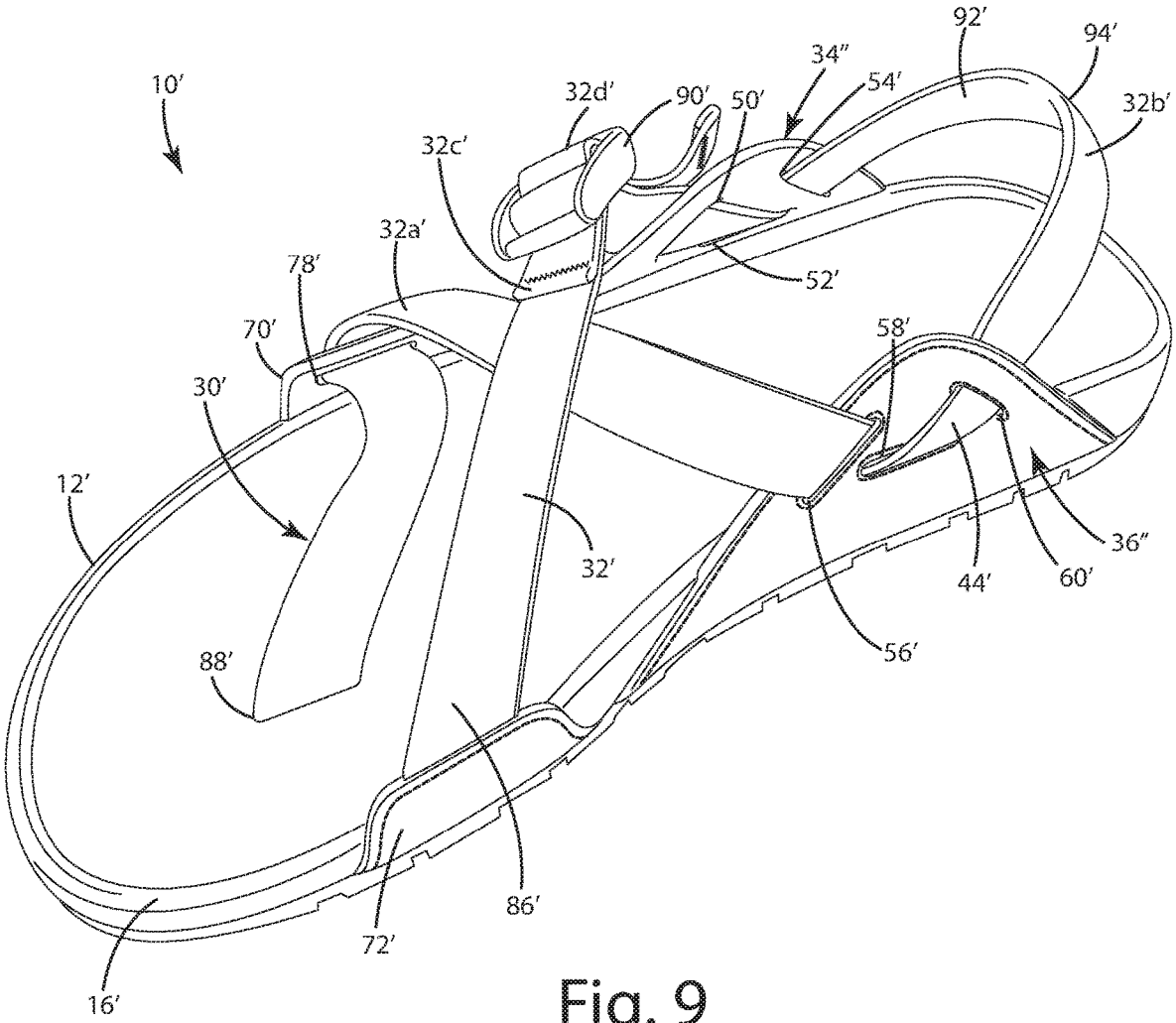
FIG. 9 is a perspective view of another alternative sandal incorporating an alternative ankle post.

In alternate embodiments, the ankle posts 34, 36 may also be provided in alternate geometric shapes. For example, the "mountain" shape as shown in FIG. 9. Of course, other suitable shapes are also contemplated herein.

According to another embodiment, the sandal 10 and strap system 30 provide a simple and readily replaceable strap arrangement in the event that the strap 32 should wear out or become damaged. The strap system 30 is designed and configured to make replacing the strap 32 relatively easy to do. As described above, the strap 32 can extend through one of the slots and double back over itself. The strap 32 can be stitched onto itself in one or more locations to attach the strap 32 to the sole assembly 12. To replace the strap 32, the stitching can be removed, the damaged strap can removed, a new strap can installed in the same described strap arrangement, and then the strap 32 can be stitched onto itself in the same location(s) as originally provided. This provides a simple way to replace damaged straps and extend the life of the sandal 10.

Figure 7:
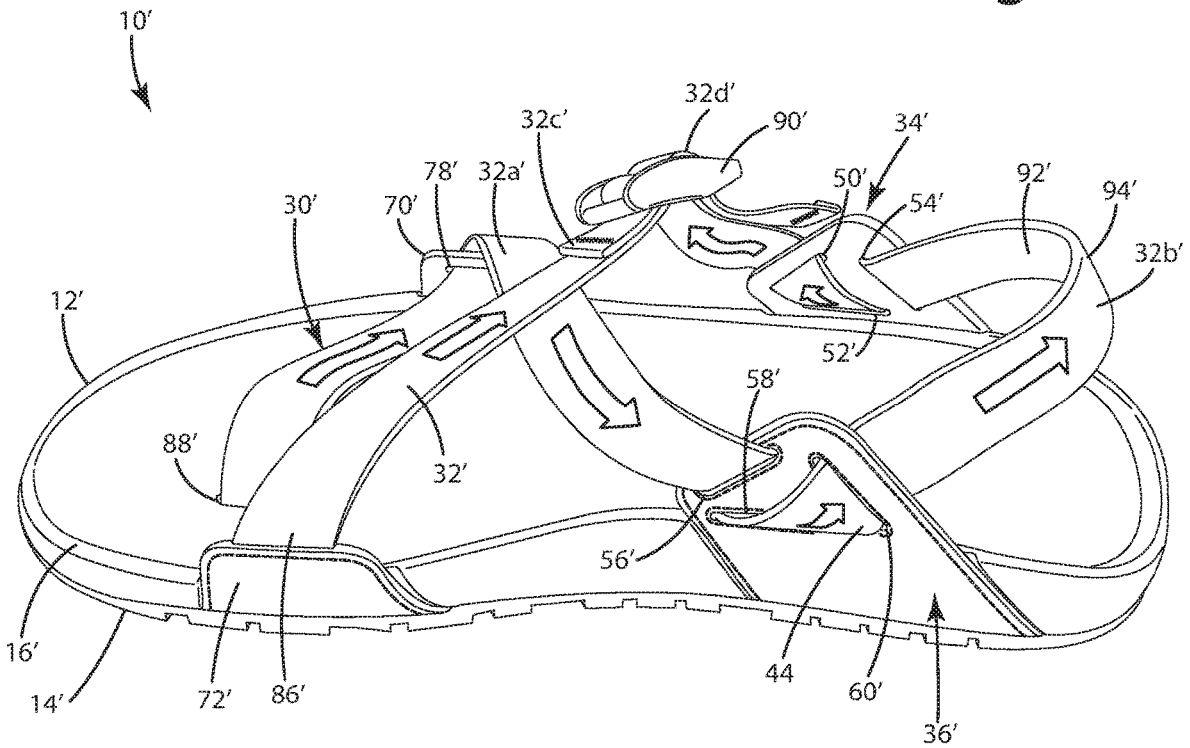
FIG. 7 is a perspective view of an alternative sandal incorporating an alternative strap system.
Figure 8:
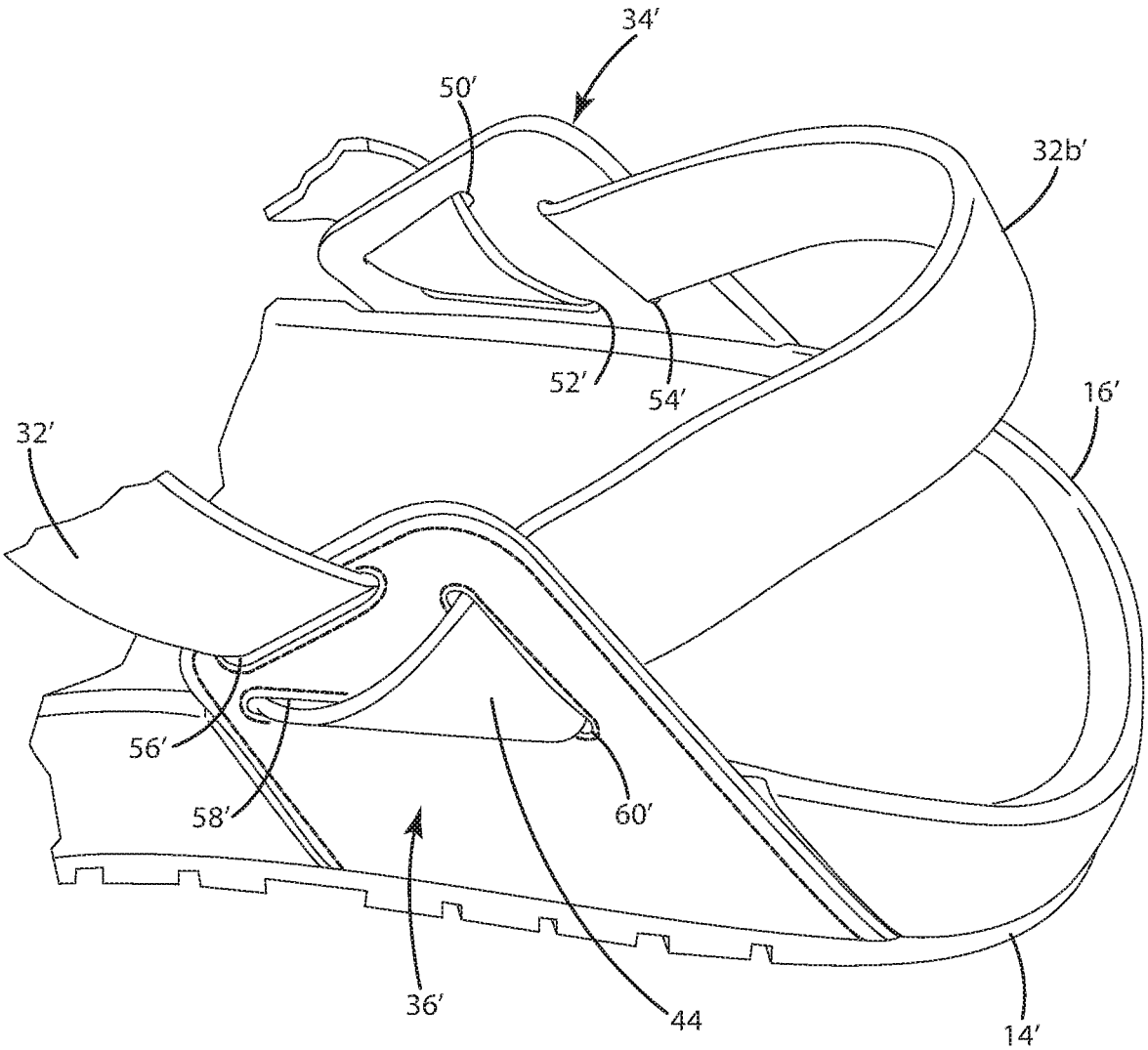
FIG. 8 is an enlarged view of the ankle portion of the alternative sandal.

Referring to FIGS. 7-8, in an alternative embodiment, the strap system 30' may include an alternate strap configuration. The strap system 30' includes the strap 32', which defines first and second opposed ends 86' and 88' having a length defined therebetween. The first strap end 86' is configured to be joined with the sole assembly 12' in the forefoot region 22', and the second strap end 88' is configured to be joined to the sole assembly 12' also in the forefoot region 22', for example, as a thong between the wearer's first and second toes. In this embodiment, the first end 86' of the strap 32' is affixed to the medial forefoot post 72'. From there, the strap 32' crosses the sole assembly 12', extending from the forefoot region 22' to the ankle region 26'. The strap 32' is threaded through the slots 50'-54' of the lateral ankle post 34' in the threading pattern described above. As shown, the threading pattern includes threading the strap 32' straight through the first slot 50'; the strap 32' emerges from the first slot 50' and extends out through the second slot 52'. The strap 32' is twisted or folded 44 upon itself and then continues straight though the third slot 54'. After passing through the lateral ankle post 34', the strap 32' crosses the sole assembly 12' to the medial ankle post 36', rearward of the wearer's heel. In this embodiment, the medial ankle post 36' is substantially mirror image of the lateral ankle post 34' and includes slots 56'-60'. The strap 32' is threaded in reverse through the lateral ankle post 34' relative to the threading pattern through the medial ankle post 36'. The strap 32' is threaded straight through the sixth slot 60', passes from the sixth slot 60' to the fifth slot 58' and extends out fifth slot 58'. The strap 32' is then twisted or folded 44 upon itself and continues straight though the fourth slot 56'. The strap 32' continues its path over the top of the foot toward the forefoot region 22' and loops through the lateral slot 78' in the lateral forefoot post 70'. The strap terminates at its second end 88' embedded in the sole assembly 12' in the forefoot region 22' as a thong between the wearer's first and second toes.

This alternate embodiment strap system 30' may include a length-adjustment arrangement. For example, the strap system 30' includes a buckle 90' on the strap 32' between the lateral ankle post 34' and the medial forefoot post 72' for adjusting the effective length of the strap 32'. The strap 32' is split at buckle 90', thus defining a strap forefoot portion 32*a'* and a strap heel portion 32*b'* terminating in respective a forefoot portion end 32*c'* and an heel portion end 32*d'*. The strap forefoot portion 32*a'* is affixed to the buckle 90' at the forefoot portion end 32*c'*, and the strap heel portion 32*b'* is fed through the buckle 90' in a conventional manner. In this orientation, the heel portion end 32*d'* is left free for a user to pull to allow the effective length of the entire strap 32' to be adjusted. In this case, pulling the heel portion end 32*d'* pulls the buckle 90' toward the lateral ankle post 34', thus tightening the strap forefoot portion 32*a'* over the foot and shortening the effective length of the strap heel portion 32*b'*. In this arrangement, the buckle 90' is configured to loosen and tighten the strap 32' throughout both the ankle region 26' and the forefoot region 22' as illustrated with arrows in FIG. 7. Of course, it should be understood that the buckle 90' could be oriented in the opposite direction and the strap 32' could be tightened and loosened oppositely.

Figure 10:
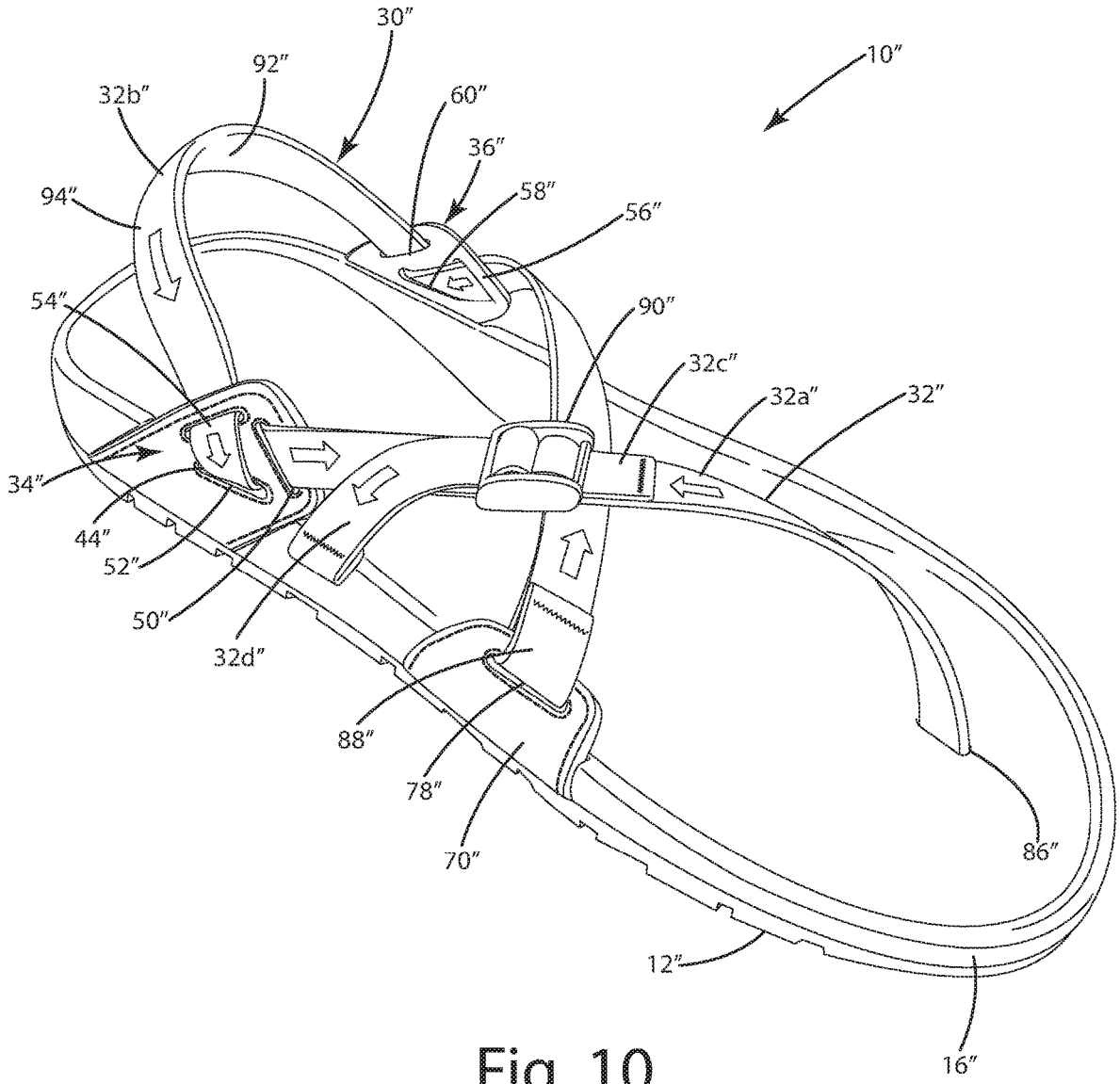
FIG. 10 is a perspective view of an alternative sandal incorporating another alternative strap system.

Referring to FIG. 10, in yet another alternative embodiment, the strap system 30" may include an alternate strap configuration. The strap system 30" includes the strap 32", which defines first and second opposed ends 86" and 88" having a length defined therebetween. The first and second strap ends 86" and 88" are configured to be joined with the sole assembly 12" in the forefoot region 22". In this embodiment, the first end 86" of the strap 32" is embedded in the sole assembly 12" in the forefoot region 22" as a thong between the wearer's first and second toes. From there, the strap 32" crosses the sole assembly 12", extending from the forefoot region 22" to the ankle region 26". The strap 32" is threaded through the slots 50"-54" of the lateral ankle post 34" in the threading pattern described above. As shown, the threading pattern includes threading the strap 32" straight through the first slot 50"; the strap 32" emerges from the first slot 50" and extends out through the second slot 52". The strap 32" is then twisted or folded 44 upon itself and continues straight though the third slot 54". After passing through the lateral ankle post 34", the strap 32" crosses the sole assembly 12" to the medial ankle post 36", rearward of the wearer's heel. In this embodiment, the medial ankle post 36" is substantially mirror image of the lateral ankle post 34" and includes slots 56"-60". The strap 32" is threaded in reverse through the lateral ankle post 34" relative to the threading pattern through the medial ankle post 36". The strap 32" is threaded straight through the sixth slot 60", passes from the sixth slot 60" to the fifth slot 58" and extends out fifth slot 58". The strap 32" is then twisted or folded 44 upon itself and continues straight though the fourth slot 56". The strap 32" continues its path over the top of the foot toward the forefoot region 22" through the lateral slot 78" in the lateral forefoot post 70" and can be looped back (doubled back) over and attached to itself via stitching.

This alternate embodiment strap system 30" may include a length-adjustment arrangement. For example, the strap system 30" includes a buckle 90" on the strap 32" for adjusting the effective length of the strap 32". The strap 32" is split at buckle 90", thus defining a strap forefoot portion 32*a"* and a strap heel portion 32*b"* terminating in respective forefoot portion end 32*c"* and an heel portion end 32*d"*. The strap forefoot portion 32*a"* is affixed to the buckle 90" at the forefoot portion end 32*c'*, and the strap heel portion 32*b'* is fed through the buckle 90" in a conventional manner. In this orientation, the heel portion end 32*d"* is left free for a user to pull to allow the effective length of the entire strap 32" to be adjusted. In this case, pulling the heel portion end 32*d"* pulls the buckle 90" toward the lateral ankle post 34", thus tightening the strap forefoot portion 32*a"* over the foot. The strap heel portion 32*b"* behind the heel is also effectively shortened. In this arrangement, the buckle 90" is configured to loosen and tighten the strap 32" throughout both the ankle region 26" and the forefoot region 22" as illustrated with arrows in FIG. 10. Of course, it should be understood that the buckle 90" could be oriented in the opposite direction and the strap 32" could be tightened and loosened oppositely.

Figure 11:
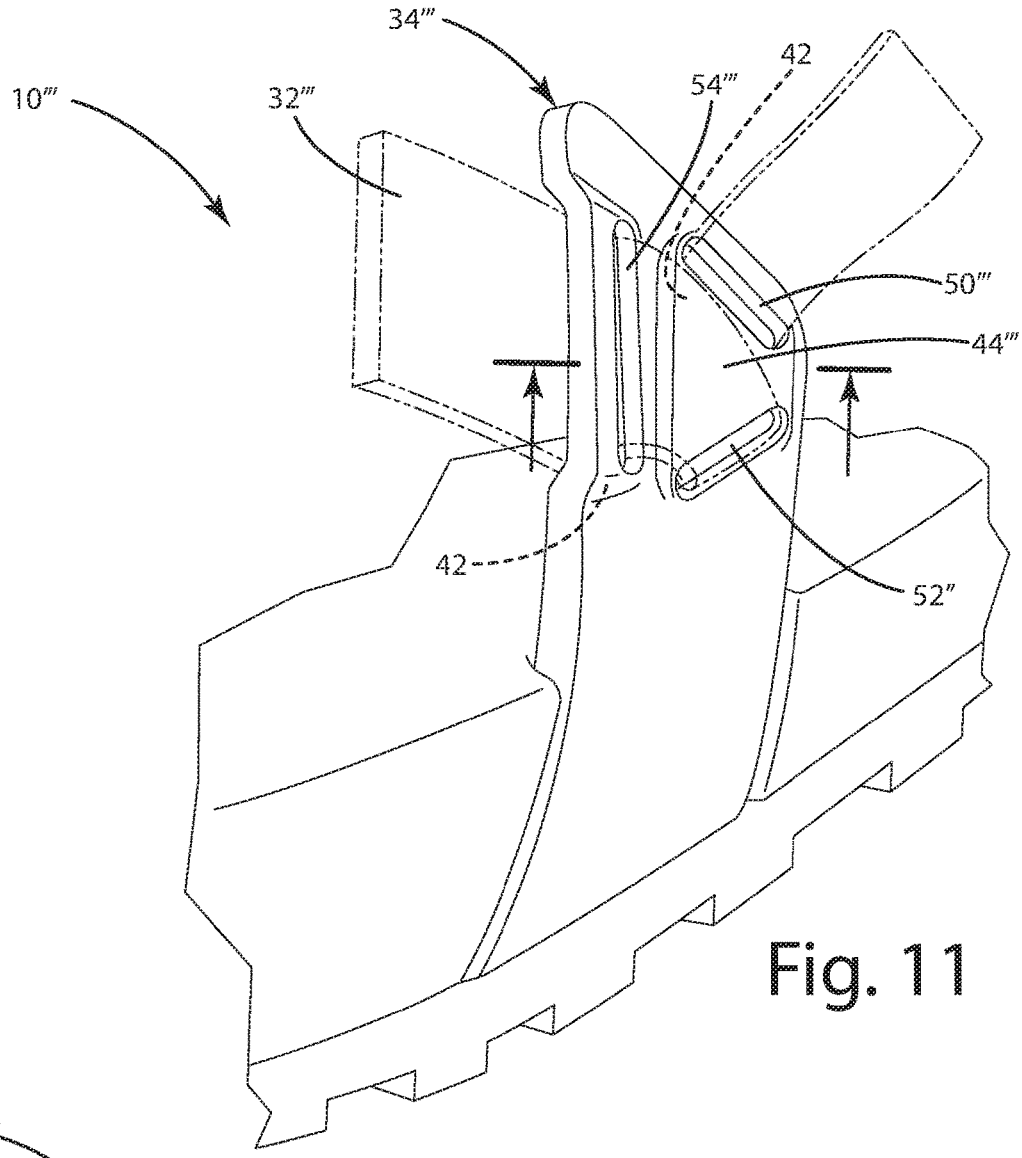
FIG. 11 is a partial side view of an alternative ankle portion of the sandal incorporating press molding the ankle post.
Figure 12:
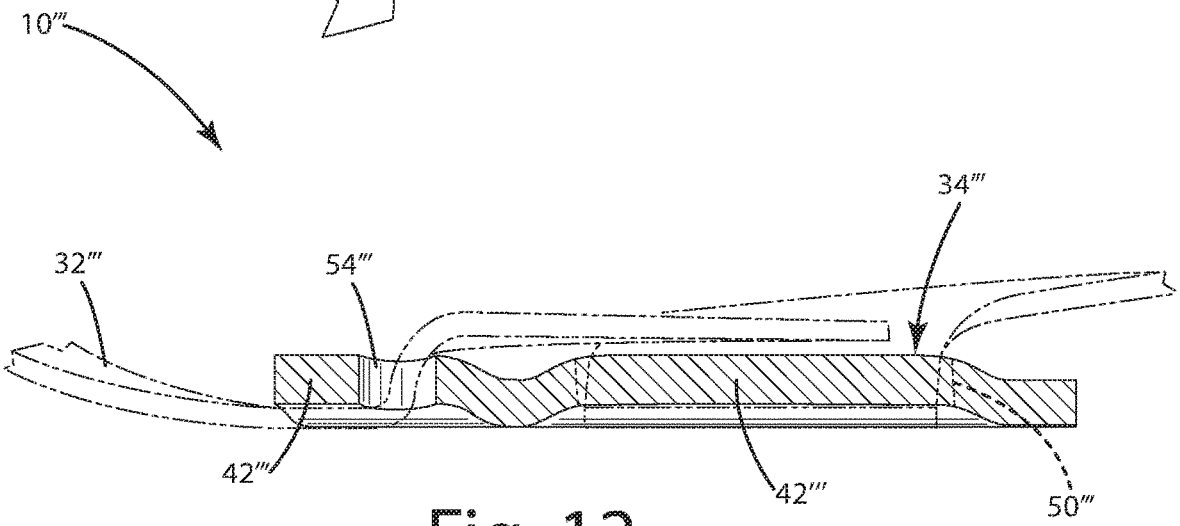
FIG. 12 is a cross-sectional view through the ankle post of FIG. 11.

If desired, one or more of the ankle posts may be contoured to assist in routing the strap through the ankle post. For example, FIG. 11 shows an ankle post 34'" that has been press molded or otherwise shaped to add a contoured impression 42 to the ankle posts 34". As shown in the cross-section of the ankle post illustrated in FIG. 12, the ankle post 34'" can be "pushed" or "pressed" out in selected areas, defining impressions 42 that function as channels through which the strap may pass. Press molding, or any other suitable manufacturing method, does not necessarily change the thickness of the ankle strap 34'" in the selected area, but changes the cross-sectional shape. In the areas where the strap 32'" lies adjacent the inner lining, the strap 32'" can be "nested" in the impression 42 to provide a flush, or at least more flush, surface to contact the wearer's foot. It should be understood that pushing the surface "out" indicates that a portion of the inner surface (the impression 42) is pushed away from the wearer's foot. It should also be understood that impressions may be included in any of the other sandal posts. Further, the impression 42 may extend beyond the surface area adjacent the strap, as deemed desirable for the overall appearance of the sandal. As an alternative to press-molding, the ankle post may be provided with contour using other manufacturing techniques. For example, the ankle post may be a molded component and the desired contours may be formed as part of the molding process.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A sandal comprising:

a sole having an ankle region and a forefoot region;

a first ankle post extending upwardly from the sole in the ankle region;

a strap guide feature disposed on the first ankle post, the strap guide feature including an arrangement of a plurality of keepers, the keepers being in the form of slots through the first ankle post, an arrangement of the slots includes first, second, and third slots arranged in a substantially triangular configuration; and a strap system having at least one strap, a portion of the strap threaded through the keepers and extending behind a heel of a wearer's foot and from the ankle region into the forefoot region, the arrangement of slots configured to position and maintain the strap in a preselected orientation with respect to the wearer's foot, wherein the strap includes a fold associated with at least one of the plurality of keepers, the strap is selectively moveable through the plurality of keepers such that the strap system is adjustable to loosen and tighten around the heel and in the forefoot region to secure the sandal to the wearer's foot;

wherein the second slot is oriented at an angle of between about −5 to about +5 degrees relative to horizontal, the first slot is oriented at an angle between about +40 and +50 degrees relative to the second slot, and the third slot is oriented at an angle between about −40 and −50 degrees relative to the second slot; and further defining a threading pattern wherein a portion of the strap is threaded straight through the first slot, threaded through the second slot and folded, and threaded straight through the third slot, the threading pattern providing intentional adjustment of the strap through the first ankle post while resisting unintentional slipping of the strap through the first ankle post.

2. The sandal of claim 1 wherein the strap defines first and second sides, wherein the threading pattern provides that the first side is facing outward on a first side of the fold and the second side is facing outward on a second side of the fold.

3. The sandal of claim 1 including a second ankle post extending upwardly from the sole and opposite the first ankle post, the second ankle post including fourth and fifth slots, wherein the strap includes opposed ends having a length defined between the ends, the ends configured to be joined with the sole and the second ankle post.

4. The sandal of claim 3 including first and second forefoot strap guides disposed on opposite sides of the sole in the forefoot region, wherein a first end of the strap is affixed to the sole, the strap crossing the sole in the forefoot region, the strap extending through the second forefoot strap guide, the strap crossing the sole between the forefoot region and the ankle region, the strap extending through the fourth slot in the second ankle post, the strap crossing the sole between the second ankle post and the first ankle post forward of an ankle of a wearer, the strap threading through first, second, and third slots of the first ankle post, and the strap crossing the sole to the second ankle post behind a heel of the wearer, wherein the strap terminates at a second end, the second end affixed to the second ankle post.

5. The sandal of claim 4 wherein the strap system includes a buckle for adjusting the length of the strap, the buckle disposed on the strap between the first and second ankle posts and configured to loosen and tighten the strap in both the ankle region and the forefoot region.

6. The sandal of claim 5 wherein the first end of the strap is looped through the first forefoot strap guide and attached to itself, and the second end of the strap is looped through the fifth slot of the second ankle post and attached to itself.

7. An adjustable fit sandal comprising:

a sole having an ankle region and a forefoot region;

a first ankle post extending upwardly from the sole in the ankle region, the ankle post including a plurality of slots disposed therethrough;

a strap system having at least one strap, including a first end and a second end, and having a length defined between the first and second ends, the first end affixed to the sole in the forefoot region, a portion of the strap threaded through the plurality of slots to slidably affix the strap to the first ankle post, a portion of the strap traversing the sole in the ankle region; and an adjustment mechanism for adjusting the length of the strap, the adjustment mechanism configured to loosen and tighten the strap around a wearer's foot in both the ankle region and the forefoot region;

wherein the plurality of slots includes first, second, and third slots arranged in a substantially triangular configuration, the configuration of slots positioning the strap in a preselected orientation with respect to the wearer's foot;

wherein the second slot is oriented at an angle of between about −5 to about +5 degrees relative to horizontal, the first slot is oriented at an angle between about +40 and +50 degrees relative to the second slot, and the third slot is oriented at an angle between about −40 and −50 degrees relative to the second slot; and wherein a portion of the strap is threaded straight through the first slot, threaded through the second slot, folded, and threaded straight through the third slot, providing intentional adjustment of the strap through the first ankle post and resisting unintentional slipping of the strap through the first ankle post.

8. The adjustable fit sandal of claim 7 including a second ankle post including fourth, fifth, and sixth slots arranged in a substantially triangular configuration, wherein a portion of the strap is threaded straight through the fourth slot, threaded through the fifth slot, folded, and threaded straight through the sixth slot.

9. A sandal comprising:

a sole having an ankle region and a forefoot region;

a medial ankle post and a lateral ankle post extending upwardly from the sole in the ankle region, the lateral ankle post including first, second, and third slots arranged in a substantially triangular configuration, the medial ankle post including fourth and fifth slots;

a medial forefoot post and a lateral forefoot post extending upwardly from the sole in the forefoot region, each forefoot post including a slot;

a strap system having at least one strap including first and second ends, the first end of the strap affixed to the medial forefoot post, the strap crossing the sole in the forefoot region, the strap slidably extending through the slot of the lateral forefoot post, the strap crossing the sole between the forefoot region and the ankle region, the strap slidably extending through the fourth slot in the medial ankle post, the strap crossing the sole between the medial ankle post and the lateral ankle post forward of an ankle of a wearer, the strap slidably threading through first, second, and third slots of the lateral ankle post and including a fold between the second and third slots, the strap crossing the sole to the medial ankle post behind a heel of the wearer, the strap affixed at the second end to the medial ankle post; and an adjustment mechanism configured to loosen and tighten the strap around a wearer's foot through both the ankle region and the forefoot region.

10. The sandal of claim 9 wherein the second slot is oriented at an angle of between about −5 to about +5 degrees relative to horizontal, the first slot is oriented at an angle between about +40 and +50 degrees relative to the second slot, and the third slot is oriented at an angle between about −40 and −50 degrees relative to the second slot.

11. The sandal of claim 9 wherein the strap defines first and second sides, wherein the strap is threaded through the lateral ankle post such that the first side is facing outward on a first side of the fold and the second side is facing outward on a second side of the fold.

* * * * *